US010711455B2

(12) United States Patent
Underwood

(10) Patent No.: US 10,711,455 B2
(45) Date of Patent: Jul. 14, 2020

(54) EXPANSION JOINTS

(71) Applicant: Underwood Companies Holdings Pty Ltd, Brisbane, QLD (AU)

(72) Inventor: Daniel Charles Underwood, Brisbane (AU)

(73) Assignee: Underwood Companies Holdings Pty Ltd, Brisbane (AU)

( * ) Notice: Subject to any disclaimer, the term of this patent is extended or adjusted under 35 U.S.C. 154(b) by 0 days.

(21) Appl. No.: 16/134,803

(22) Filed: Sep. 18, 2018

(65) Prior Publication Data

US 2019/0017258 A1 Jan. 17, 2019

Related U.S. Application Data

(63) Continuation of application No. 15/492,803, filed on Apr. 20, 2017, now Pat. No. 10,113,308.

(30) Foreign Application Priority Data

Apr. 20, 2016 (AU) ..... 2016901476
Dec. 7, 2016 (AU) ..... 2016905039

(51) Int. Cl.
*E04B 1/68* (2006.01)

(52) U.S. Cl.
CPC ..... *E04B 1/681* (2013.01); *E04B 1/6804* (2013.01)

(58) Field of Classification Search
CPC ..... E04B 1/681; E04B 1/6804; E04B 1/68; E04F 15/02016
See application file for complete search history.

(56) References Cited

U.S. PATENT DOCUMENTS

| | | | | |
|---|---|---|---|---|
| 3,903,587 | A | 9/1975 | Boiardi | |
| 4,651,488 | A | 3/1987 | Nicholas et al. | |
| 4,901,495 | A | 2/1990 | Gottschling | |
| 4,922,676 | A | 5/1990 | Spronken | |
| 5,263,294 | A | 11/1993 | Koenig et al. | |
| 5,333,432 | A | 8/1994 | Schlüter | |
| 5,887,400 | A | 3/1999 | Bratek | |
| 8,769,883 | B2 * | 7/2014 | Bazzarini | F21V 33/006 362/153 |
| 9,062,453 | B1 | 6/2015 | Maziarz | |
| 2001/0017015 | A1 | 8/2001 | Schluter | |
| 2002/0059764 | A1 | 5/2002 | Schluter | |

(Continued)

FOREIGN PATENT DOCUMENTS

| | | |
|---|---|---|
| DE | 1658865 | 11/1971 |
| DE | 344507 | 6/1986 |

(Continued)

*Primary Examiner* — Christine T Cajilig
(74) *Attorney, Agent, or Firm* — Bonini IP Law, LLC; Frank J. Bonini, Jr.

(57) ABSTRACT

Tiles 21 and 22 are laid up with other tiles in the usual way at and along the joint 18, the joint 18 comprises a female strip 23 and a male strip 24 each of which have fastening flanges 25 and 26 and respective 90° walls 27 and 28. A slot or rebate in the female section 29 holds an expandable seal, typically in this case a hydrophilic seal. The female part and the male parts are assembled for relative movement so that a small gap perhaps 2 mm at 31 may be accommodated while the the upper plate section 23 still provides a contiguous coplanar link between the parts.

13 Claims, 9 Drawing Sheets

(56) References Cited

U.S. PATENT DOCUMENTS

| | | | |
|---|---|---|---|
| 2013/0202348 | A1 | 8/2013 | Jensen |
| 2013/0232901 | A2 | 9/2013 | Findlay |

FOREIGN PATENT DOCUMENTS

| | | | |
|---|---|---|---|
| DE | 29501204 | | 3/1995 |
| DE | 29617612 | | 1/1996 |
| DE | 19753937 | C1 | 5/1999 |
| DE | 202010015513 | | 3/2011 |
| DE | 102011008693 | | 7/2012 |
| DE | 202016007085 | | 2/2017 |
| EP | 0165611 | | 12/1985 |
| EP | 2497877 | | 9/2012 |
| GB | 1485950 | A | 9/1977 |
| GB | 2278134 | B | 11/1994 |

* cited by examiner

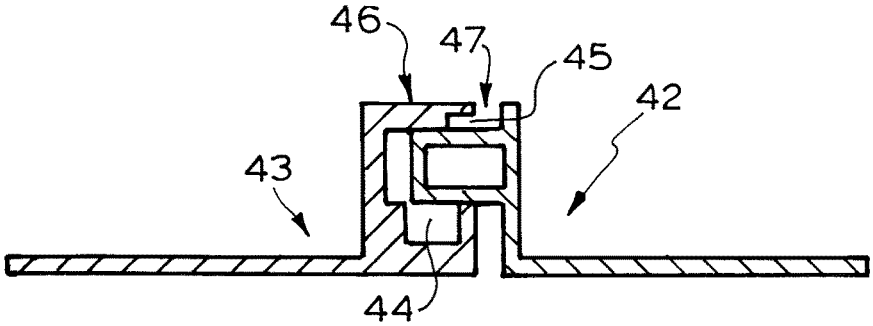
FIG.12
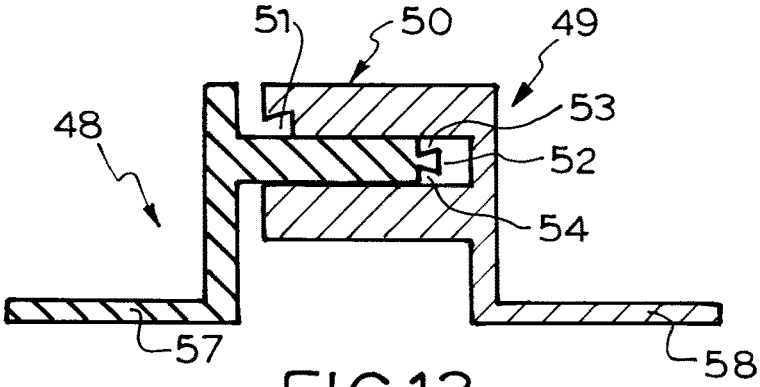
FIG.13
FIG.14A
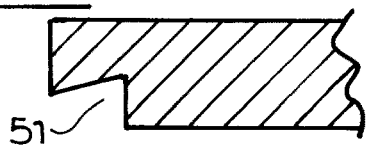
FIG.14B
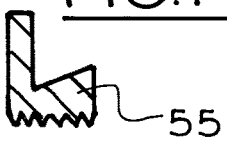
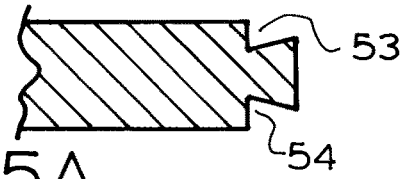
FIG.15A
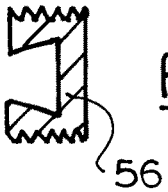
FIG.15B
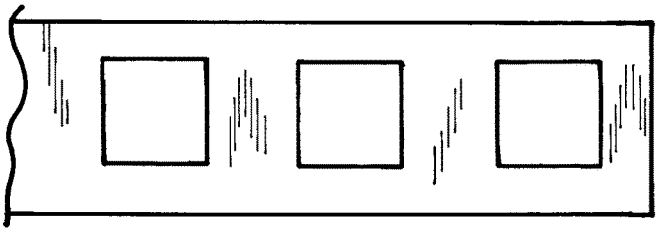
FIG.16

EXPANSION JOINTS

TECHNICAL FIELD

THIS INVENTION relates to improvements in or in relation to expansion joints that are involved in application of a layer applied to a substrate. The present invention has general application where a relatively thin layer, tiles or the like may be applied to a substrate.

BACKGROUND

Expansion joints, generally speaking, is a crowded art with many patents having been granted particularly in the area of expansion and contraction of concrete slabs where the joint between the slabs expands in response to contraction of a drying slab. Where tiles, stucco or plaster are laid up on a substrate such as a concrete slab or a wall movement of the substrate and/or the tiles creates a situation where there can be cracking or separation in the floor or wall.

In the case of tiles these are quite often ceramic tiles. The substrate and/or the tiles may move due to expansion and/or contraction. It is desirable to provide expansion joints in the form of divider strips that allow for this movement.

It is conventional practice to form expansion joints in tiling floors where simple strips of angle are placed side by side with one flange adhered horizontally to the substrate and the other flange at 90 degrees is upright. Tiles are applied over the horizontal flange up to the vertical upright flange. A caulking or other flexible seal is applied to the gap between the vertical flanges of the space strips. Over time there can be unsightly separation of the tiles or the seal from the strip. This creates gaps where debris can accumulate. In food areas, food particles can accumulate in these gaps, liquids can pass through and under the tiles. Reparation and repair costs can be high as whole sections of tiles may have to be removed and replaced which can change the whole look of a tile section in say a shopping mall where wear and tear on the surrounding tiles that remain, compared to the newer replaced tiles, can be detrimental to the whole look of the flooring in what is otherwise intended to be a desirable sales environment. This can generate complaints from store owners and tenants and there is also the inconvenience of having the tiles relaid.

The present applicant has conducted a search post invention in order to see just what kinds of expansion joints have been used in relation to ceramic tiles or other layered arrangements where these layered arrangements are layered up on a substrate and has found the following:

U.S. Pat. No. 3,903,587;
U.S. Pat. No. 5,263,294;
U.S. Pat. No. 5,333,432;
U.S. Pat. No. 9,062,453;
U.S. Pat. No. 4,651,488;
EP0165611;
GB2278134B;
US20010017015A1;
GB1485950A;
DE202010015513;
DE19753937C1.

Inclusion of these documents is post the present invention but the contents of these patent specifications are incorporated herein by cross-reference in their entirety and the reader hereof should consult these documents in as far as they may assist in further understanding or application of the present invention. These also demonstrate examples as to where the present invention might be applied although these are considered non limiting situations.

OUTLINE

In one aspect the present invention resides in an expansion joint applied to a layer applied to a substrate, the joint having a first strip extending on one side of the joint and a second strip extending on the other side of the joint, an upper surface plate of the first strip being adapted to extend across the joint, and being disposed to move across the joint, the strips being mutually aligned for relative movement while maintaining the upper surface of the first strip in a predetermined plane relative to the second strip.

Preferably, the first and second strips comprise mutually aligned male and female co-operating parts. Typically the female part carries the upper surface plate. The female part preferably comprises a channel extending along the strip. The parts may both be made from metal or a suitable plastics. Another arrangement might involve one part plastics and one part metal.

Preferably, the joint includes one or more seals between the strips. The seals may be integrally formed as part of the strip. Typically one or both stripos have seal receiving slots or other formations adapted to retain a separate seal in a specific position.

In one embodiment there is provided a groove or channel holding a seal strip. In another embodiment there is provided a rebate holding a seal strip. In another embodiment a seal may be formed in a contact surface of one or both parts. Preferably, a seal may be formed in of a mutual contact surface of a plastics male part. Preferably, upper and lower seals are employed, the upper seal being disposed along an edge of the surface plate to move with it and seal the surface plate to the second strip. The lower seal typically moves with the second strip and seals the second strip to the first strip. Typically the lower seal is secured to an edge of the male part and seals the male part to the female part. In the case of upper and lower seals the strips typically include edge rebates serving to retain the seals in place, the edge rebates being formed along the strips to bias the seals to secure positions. The rebates may taper and typically be dovetailed. These rebates may be dovetail end portions of the respective parts and may be fitted with correspondingly dovetailed resilient strips to provide the seal.

In another embodiment a seal may be provided by the male part may having a marginal edge region which has marginal surface regions which are roughened, knurled or ribbed to provide a seal. This is more preferably provided in a plastics male part.

In another embodiment a terminal edge of the male part may have spacer to hold it spaced from an endwall of the female part. The spacer may comprise a projecting flange. This flange may be resilient, weakened or frangible. The flange may be set at 90 degrees or at an angle.

BRIEF DESCRIPTION OF THE DRAWINGS

In order that the present improvements may be more readily understood and put into practical effect reference will now be made to the accompanying drawings which illustrate preferred embodiments of the invention and wherein:

FIG. 12 is a section illustrating another embodiment;

FIG. 13 is a section illustrating another embodiment;

FIGS. 14A and 14B are sections illustrating application of a seal to the part of the embodiment of FIG. 13;

FIGS. 15A and 15B are sections illustrating application of a seal to another part of the embodiment of FIG. 13;

FIG. 16 is a top view drawing of part of the horizontal flange applicable to the embodiment of FIG. 13;

METHOD OF PERFORMANCE

Figure 1:
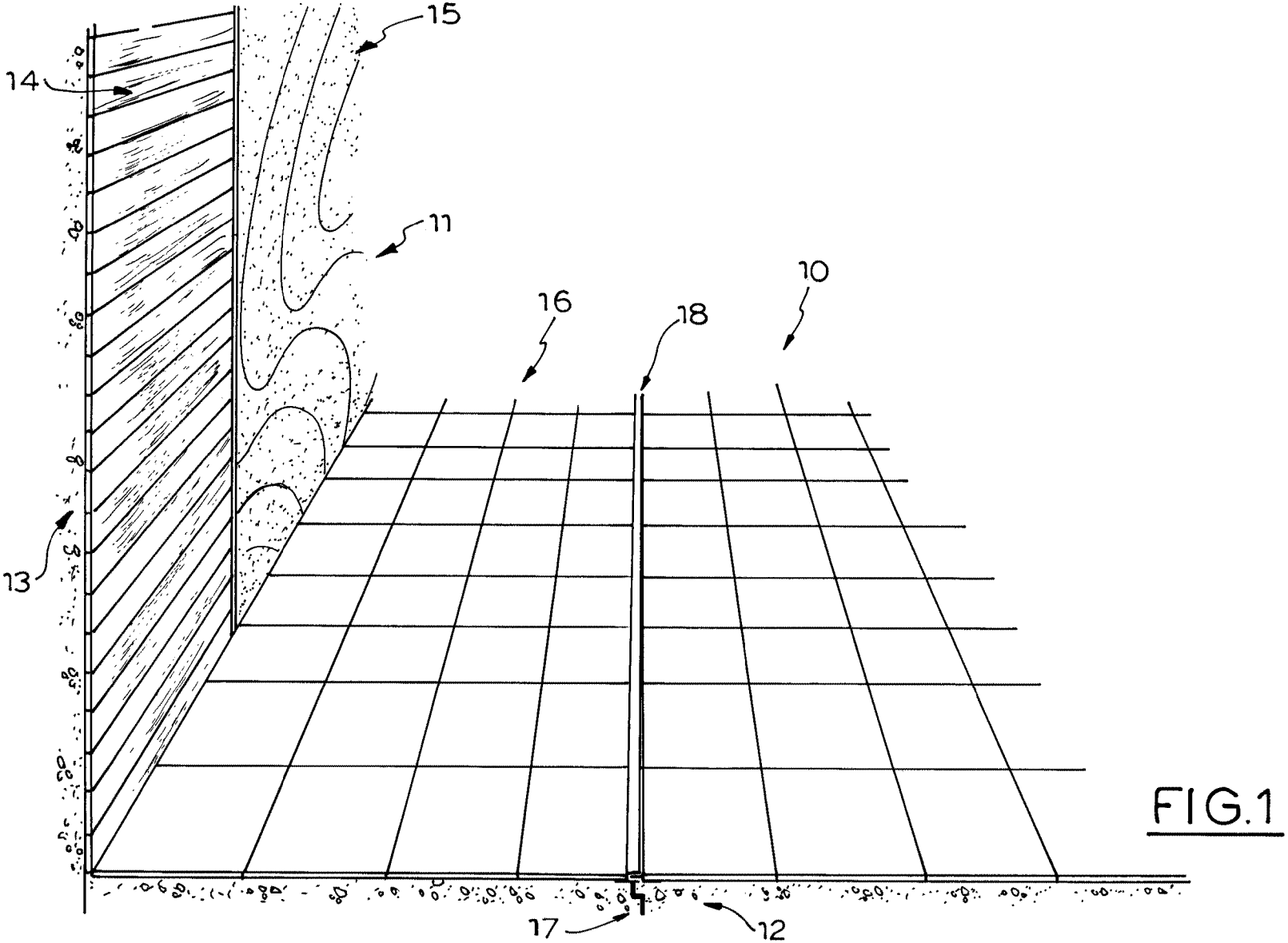
FIG. 1 is a an overall view of a flooring and a wall where the present invention is being used.

Referring to the drawings and initially to FIG. 1 there is illustrated a flooring 10 and an adjacent wall 11, the wall 11 and the flooring 10 both comprise outer layers on respective substrates 12 and 13, the substrates may typically be concrete and the outer layer of the walls may typically be timber, plaster or stucco.

The present invention may be applied to walls or floors where it is desirable to allow for expansion that may result in movement in the plane of the wall paneling at 14 or the plaster or stucco at 15 or the ceramic floor tiles at 16.

Figure 2:
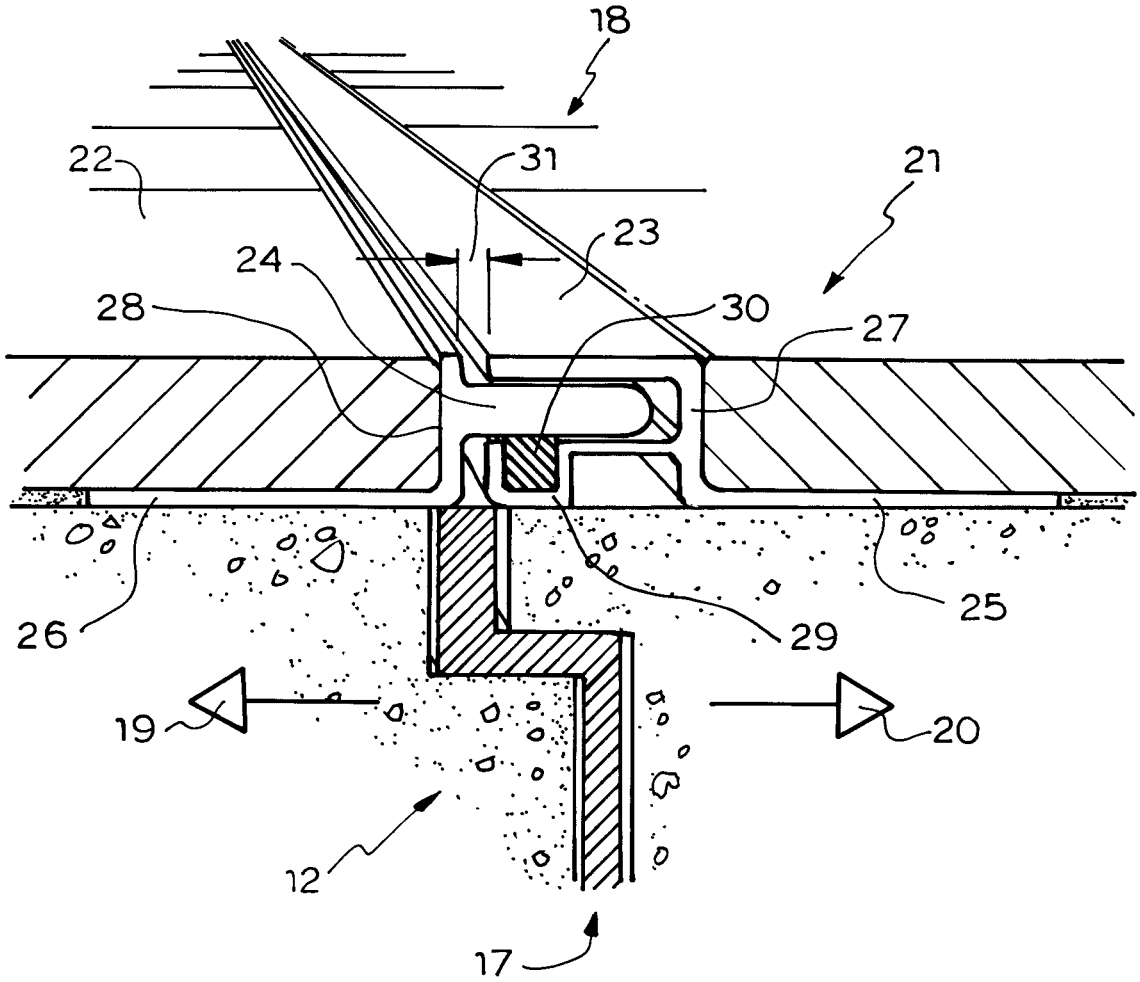
FIG. 2 is a section illustrating application of one embodiment of the present invention.

In the illustrated embodiment the concrete substrate 12 has a joint at 17 and above this is located an expansion joint 18 according to one embodiment of the present invention. The expansion joint 18 is an extruded aluminium strip made in two parts and also in this preferred embodiment employs a seal. An example is shown in FIG. 2 and like numerals illustrate like features where the arrows 19 and 20 serve to illustrate slab movement at the joint 17. Respective tiles 21 and 22 are laid up with other tiles in the usual way at and along the joint 18, the joint 18 comprises a female strip 23 and a male strip 24 each of which have fastening flanges 25 and 26 and respective 90° walls 27 and 28. A slot or rebate in the female section 29 holds an expandable seal, typically in this case a hydrophilic seal. As can be seen the female part and the male parts are assembled for relative movement so that a small gap perhaps 2 mm at 31 may be accommodated while the the upper plate section 23 still provides a contiguous coplanar link between the parts set to be aligned or as desired with respect to the applied layer such as the tiles. It could be set slightly below the tiles but the configuration of the two strips is the they slide while keeping their relationship.

Figure 4:
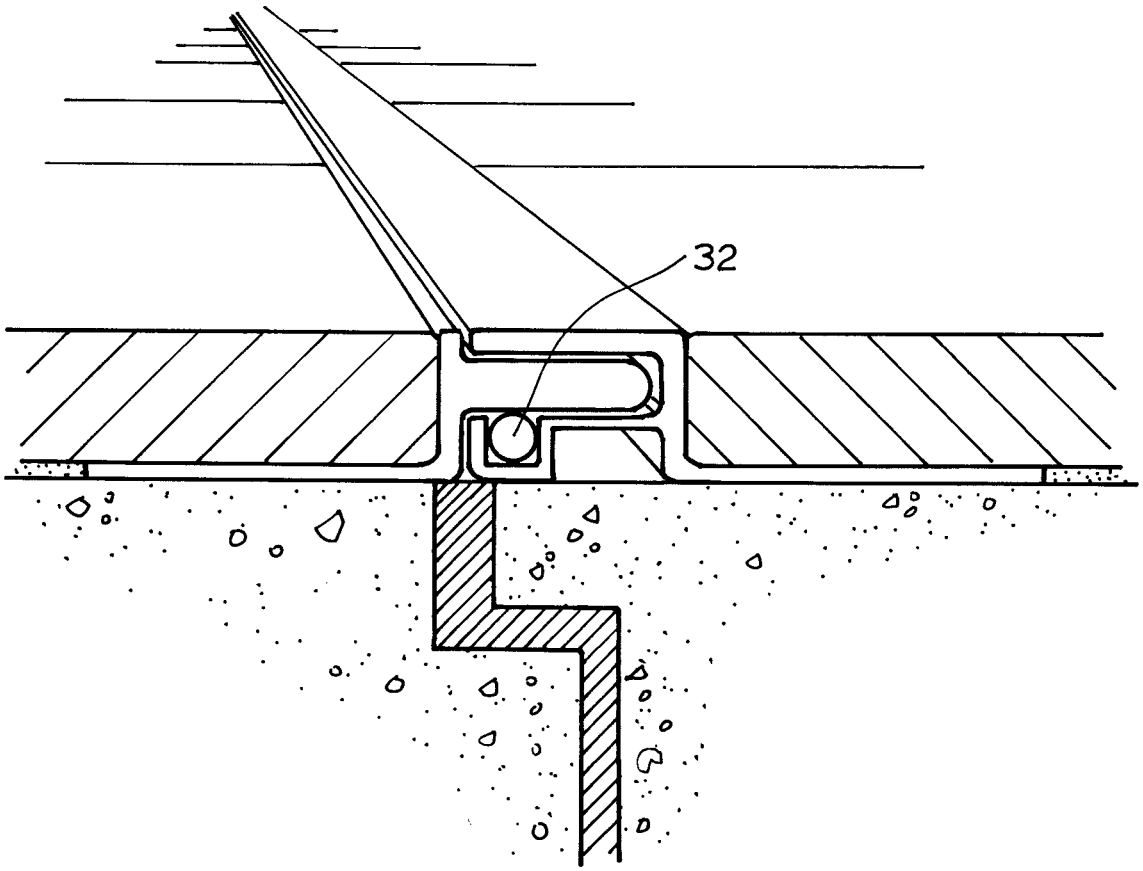
FIG. 4 is a drawing illustrating an alternate seal.
Figure 3:
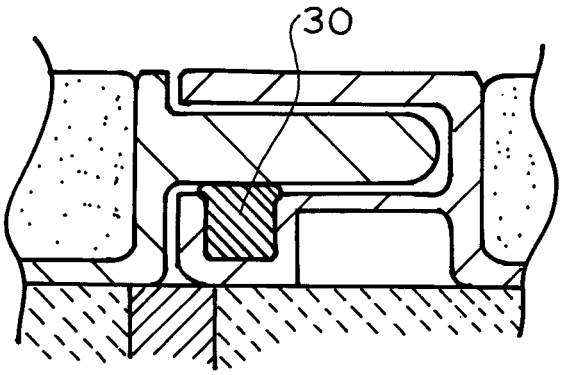
FIG. 3 is a drawing illustrating operation of a seal in the embodiment of FIG. 2.

Referring to FIGS. 3 and 4, FIG. 3 shows the seal strip 30 slightly expanded, while FIG. 4 shows a cylindrical seal 32.

Figure 5:
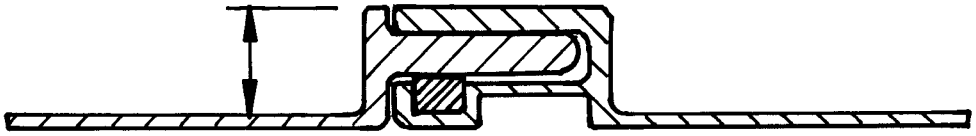
FIGS. 5 and 6 are drawings illustrating different sizes to accommodate different tile thicknesses.
Figure 6:
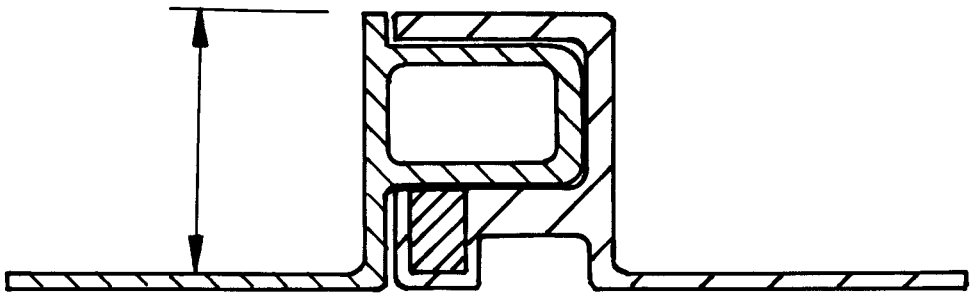
Figure 7:
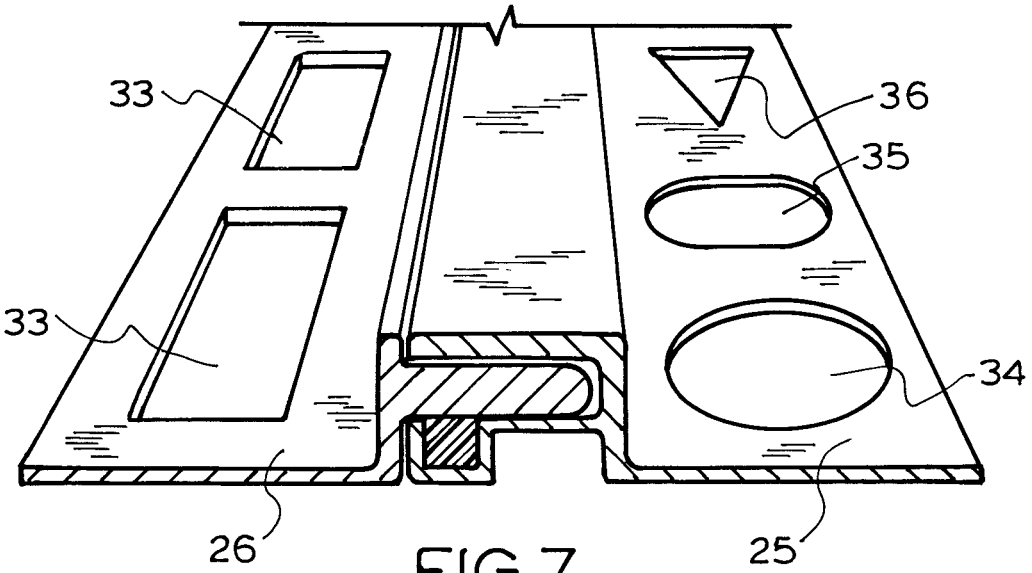
FIGS. 7 through 10 illustrate example cutouts and the components.
Figure 8:
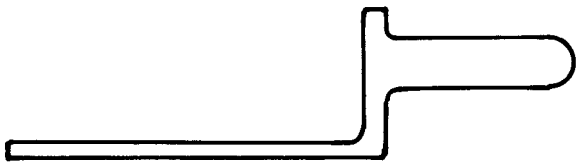
Figure 9:
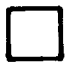
Figure 10:
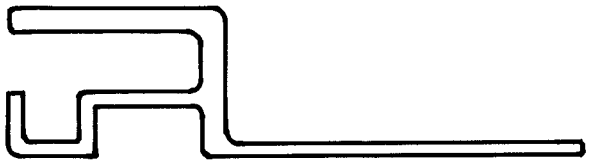

FIGS. 5 and 6 illustrate different sizes suited to different thicknesses of tiles. FIGS. 7 to 10 illustrate the assembly in perspective view of FIG. 7 which shows cutouts in the flanges 25 and 26 that facilitate securement of the flanges 25 and 26 to the substrate. A variety of these are possible and they range from square/rectangular at 33, circular at 34, oval at 35 and triangular at 36 so any suitable arrangement in the flanges to aid securement may be applicable to the present invention.

Figure 11:
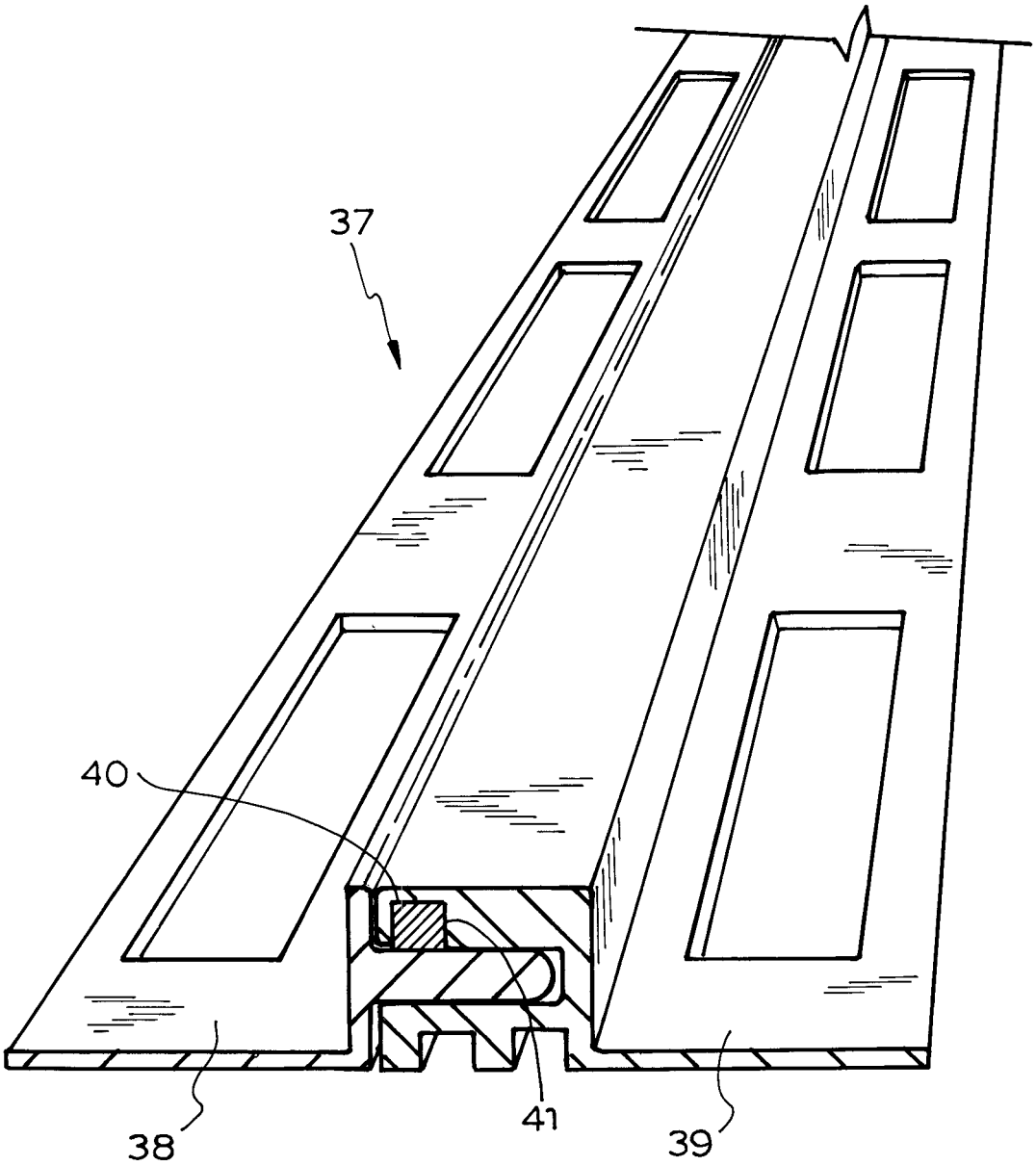
FIG. 11 illustrates a different part of the seal.
Figure 17B:
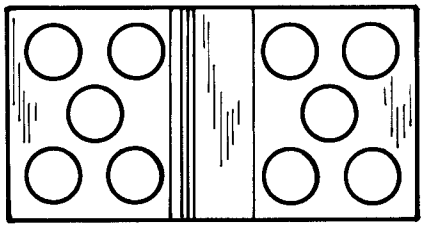
FIGS. 17A through 17D illustrate one example of the embodiment of FIGS. 13 to 16 as applied to a 20 mm thick tile layer.
Figure 17D:
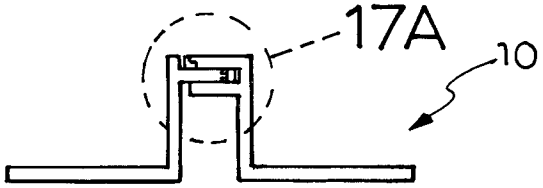
Figure 17A:
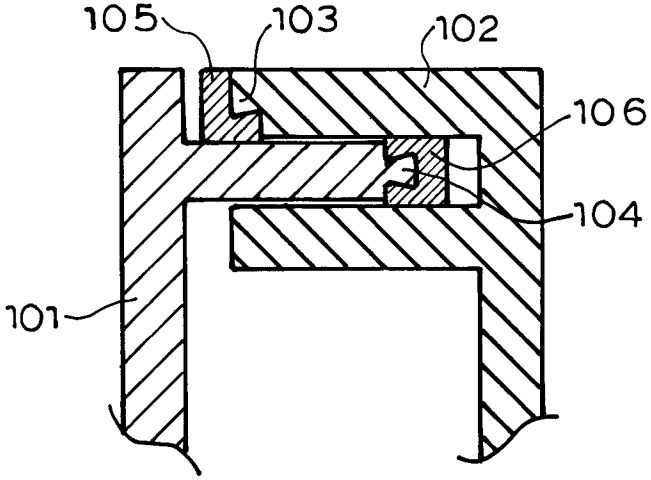
Figure 17C:
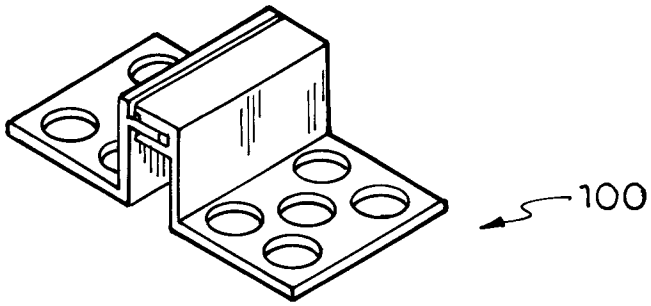
Figure 18B:
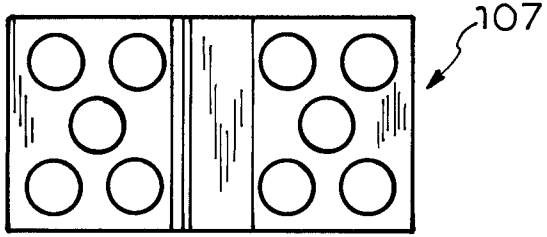
FIGS. 18A through 18D is a further embodiment illustrating application of the present invention to a plastics male half and an Aluminium female part.
Figure 18D:
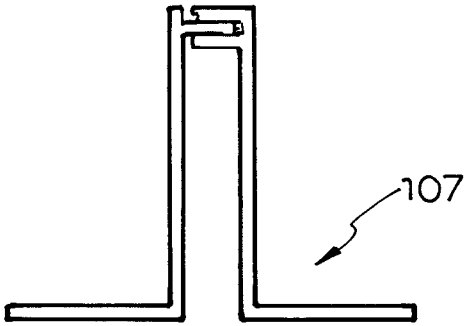
Figure 18A:
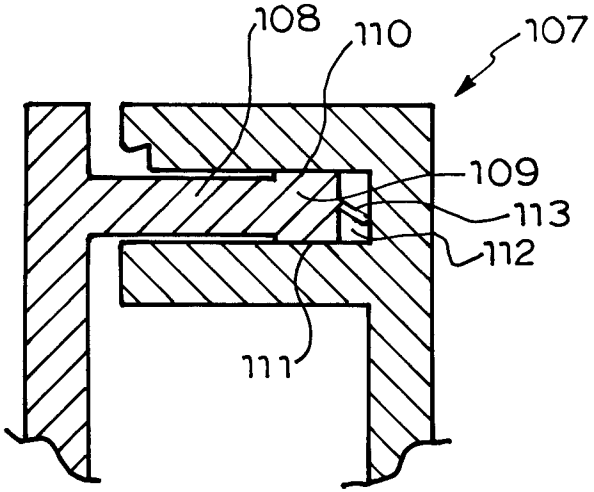
Figure 18C:
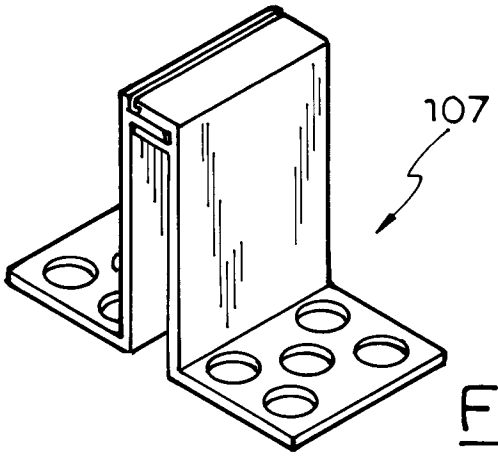

FIG. 11 shows an alternative embodiment 37. In this case there is provided flanges 38 and 39 and the female part has an upper seal housing channel 41 and a seal 40 is located in this channel. This differs in seal position.

There are of course many variations on the present invention. For example FIG. 12 is a section of another variation of an expansion joint which in this case also utilises male and female parts with strips 42 and 43, a seal channel 44, an upper surface 46 and the upper surface having edge rebate at 45 adapted to secure an upper seal adjacent to the gap 47. Thus there are two seals.

FIG. 13 illustrates a further embodiment where in this a male strip 48 is engaged with a female strip 49 where the female portion of the upper plate 50 has a rebate 51. The rebate 51 is undercut in dovetail fashion to secure a compressible EDPM rubber seal as illustrated in FIG. 14B. The seal fits under the dovetailed rebate illustrated in enlarged form in FIG. 14A. Likewise a lower seal is provided on the edge at 52 of the male strip and to this end the edge 52 has opposite edge rebates 53 and 54 both of which are undercut in dovetail fashion and these bias into securement the compressible EDPM rubber seal illustrated at 56 in FIG. 15B in relation to the rebates 53 and 54 illustrated in FIG. 15A. The seals have ribbed, grooved, serrated or toothed contact surfaces.

Referring to FIG. 16, in this embodiment it is typically equipped with square holes based along the flanges 57 and 58.

FIGS. 17A through 17D illustrate one example 100 of the embodiment of FIGS. 13 to 16 as would be used with a total thickness of overlaying tiles of 20 mm. The male and female parts 101 and 102 are made from an Aluminium alloy. These have dovetail end portions at 103 and 104 and fitted to these are respective urethane strips 105 and 106 to provide a seal. The parts may both be made from a suitable plastics. Another arrangement might involve one part plastics and one part metal.

FIGS. 18A through 18D is a further embodiment 107 illustrating application of the present invention to a plastics male half and an Aluminium alloy female part. In this example a total height of 50 mm is catered for. The male part has a tongue 108 which has a bulged marginal edge region 109 which has marginal surface regions 110 and 111 which are roughened, knurled or ribbed to provide a seal. The terminal edge 112 has a projecting flange 113 used to set a 1 mm space, this flange may be resilient, weakened or frangible. In the embodiment shown there is a total movement of about 7 mm.

Whilst the above has been given by way of illustrative example many variations and modifications will be apparent to those skilled in the art without departing from the broad ambit and scope of the invention as set out in the appended claims.

The invention claimed is:

1. In a tiled floor an expansion joint applied under tiles adjacent the joint, the joint having a first strip extending on one side of the joint and a second strip extending on the other side of the joint, an upper surface plate of the first strip being adapted to extend across the joint, and being disposed to move across the joint, the strips being mutually aligned for relative movement while maintaining the upper surface of the first strip in a predetermined plane relative to the second strip, the first and second strips comprise extrusions having mutually aligned male and female co-operating parts, the female part carrying the upper surface plate and comprises a channel extending along the first strip the joint including one or more seals between the strips, a lower one of said seals being held by one of said strips and being in freely slidabale sealing engagement with the other strip for developing a gap to be filled along the upper surface plate and a filler strip being insertable into the gap and being retained therein by the strips.

2. In a tiled floor an expansion joint according to claim 1 wherein the joint includes one or more seal receiving formations adapted to retain said one or more seals.

3. In a tiled floor an expansion joint according to claim 1 wherein the said one or more seal is integrally formed as part of one of the said strips.

4. In a tiled floor an expansion joint according to claim 2 wherein a said seal receiving formations adapted to retain said one or more seal, comprises a groove or channel or an edge rebate holding a seal strip.

5. In a tiled floor an expansion joint according to claim 1 wherein the said one or more seals comprises two co-operating seals as mutual contact surfaces of the strips.

6. In a tiled floor an expansion joint according to claim 1 wherein the male part has a free edge and the free edge has seal receiving formations adapted to retain said one or more seals, said formations comprising edge rebates of opposite corners of the free edge of the male part and holding a matching seal strip sealing the first and second strips.

7. In a tiled floor an expansion joint according to claim 5 wherein the seal being formed as two co-operating seals as mutual contact surfaces of the strips, comprises the male part having a marginal edge surface regions which are roughened, knurled or ribbed to provide a seal.

8. In a tiled floor an expansion joint according to claim 1 wherein a terminal edge of the male part has a spacer to hold it spaced from an endwall of the female part.

9. In a tiled floor an expansion joint according to claim 8 wherein the spacer comprises a projecting flange.

10. In a tiled floor an expansion joint according to claim 8 wherein the spacer comprises a projecting flange, being resilient, weakened or frangible.

11. In a tiled floor according to claim 1 wherein the upper surface plate includes a rebate to aid retention of the filler strip in the gap.

12. In a tiled floor according to claim 6 wherein the upper surface plate includes a rebate to aid retention of the filler strip in the gap.

13. In a tiled floor according to claim 1 wherein one of said one or more seals is integrally formed with the male part.

* * * * *